United States Patent [19]

Asayama et al.

[11] Patent Number: 4,579,590

[45] Date of Patent: Apr. 1, 1986

[54] HIGH STRENGTH COBALT-FREE MARAGING STEEL

[75] Inventors: Yukiteru Asayama; Kazuaki Higuchi, both of Nagoya, Japan

[73] Assignee: Mitsubishi Jukogyo Kabushiki Kaisha, Tokyo, Japan

[21] Appl. No.: 586,999

[22] Filed: Mar. 7, 1984

[30] Foreign Application Priority Data

Mar. 16, 1983 [JP] Japan ..... 58-42317

[51] Int. Cl.[4] ..... C22C 38/50

[52] U.S. Cl. ..... 75/128 T; 75/128 W; 148/37; 148/142

[58] Field of Search ..... 148/142, 37, 12.3; 75/128 W, 128 T, 123 K

[56] References Cited

U.S. PATENT DOCUMENTS

| | | | |
|---|---|---|---|
| 3,262,777 | 7/1966 | Sadowski | 148/142 |
| 3,262,823 | 6/1963 | Sadowski et al. | 148/142 |
| 3,392,065 | 7/1968 | Bieber et al. | 148/142 |
| 4,443,254 | 4/1984 | Floreen | 75/123 K |
| 4,514,235 | 4/1985 | Augustin et al. | 148/37 |

FOREIGN PATENT DOCUMENTS

| | | | |
|---|---|---|---|
| 341860 | 7/1972 | U.S.S.R. | 148/142 |

OTHER PUBLICATIONS

Krass, G., Principles of Heat Treatment of Steel., 1980, p. 53.

*Primary Examiner*—L. Dewayne Rutledge
*Assistant Examiner*—Debbie Yee
*Attorney, Agent, or Firm*—Wenderoth, Lind & Ponack

[57] ABSTRACT

High strength and toughness cobalt-free maraging steel containing, by mass, 11 to 15% Ni, 0.5 to 4% Cr, 0.5 to 5.5% Mo, 0.5 to 2% Ti, 0.05% max. C, 1% max. Mn and 0.5% max. Si, the balance consisting of iron and unavoidable impurities. The amounts of Ni, Mo and Ti in the steel have the following relationship to one another:

$$\text{Ni \%} \geqq \left( \frac{3 \times \text{Mo \%}}{95.95} + \frac{3 \times \text{Ti \%}}{47.9} \right) \times 58.69$$

$$28\text{Mo \%} + 80\text{Ti \%} \geqq 150.$$

A process for heat treating this steel is also disclosed.

2 Claims, 3 Drawing Figures

HIGH STRENGTH COBALT-FREE MARAGING STEEL

BACKGROUND OF THE INVENTION

1. Field of the Invention

This invention relates to a new grade of maraging steel which has excellent properties and is inexpensive to manufacture.

2. Description of the Prior Art

There is known 18Ni (Grade 250) maraging steel having a high tensile strength of, say, 180 kg/mm$^2$. This steel, as solution treated, is relatively soft and, therefore, easy to machine or work. In order to obtain a high tensile strength of 180 kg/mm$^2$, it is sufficient to heat the solution treated steel to a temperature of, say, 500° C. for aging. The steel as solution treated can be machined or worked into the shape of a final product, since its aging does not bring about any appreciable dimensional change or develop any appreciable strain. Despite its high tensile strength, the steel retains high toughness. This steel has, however, the disadvantage of being expensive to manufacture, since it contains large quantities of cobalt, nickel and molybdenum, as shown in TABLE 1.

TABLE 1

| Chemical composition of 18Ni (Grade 250) maraging steel (mass %) | | | | | | | | | |
|---|---|---|---|---|---|---|---|---|---|
| C | Mn | P | S | Si | Ni | Co | Mo | Ti | Al |
| 0.03 max. | 0.10 max. | 0.010 max. | 0.010 max. | 0.10 max. | 17.0 to 19.0 | 7.0 to 8.5 | 4.6 to 5.2 | 0.3 to 0.5 | 0.05 to 0.15 |

SUMMARY OF THE INVENTION

It is an object of this invention to provide a novel grade of maraging steel which is inexpensive and yet retains a high tensile strength of, say, 180 kg/mm$^2$ and a high degree of toughness as well.

The maraging steel of this invention is particularly characterized by not containing any cobalt, or any large amount of nickel or molybdenum. This feature makes the steel inexpensive to manufacture.

The high strength and toughness cobalt-free maraging steel of this invention contains, by mass percentage, 11 to 15% Ni, 0.5 to 4% Cr, 0.5 to 5.5% Mo, 0.5 to 2% Ti, up to 0.05% C, up to 1% Mn and up to 0.5% Si. The balance consists essentially of iron and unavoidable impurities. The percentages of Ni, Mo and Ti have the following relationships:

$$\text{Ni \%} \geqq \left( \frac{3 \times \text{Mo \%}}{95.95} + \frac{3 \times \text{Ti \%}}{47.9} \right) \times 58.69$$

$$28\text{Mo \%} + 80\text{Ti \%} \geqq 150$$

This steel is heat treated by a process which comprises solution treating it to form a martensitic structure therein, and aging it at a temperature of at least 480° C.

DETAILED DESCRIPTION OF THE INVENTION

Figure 1:
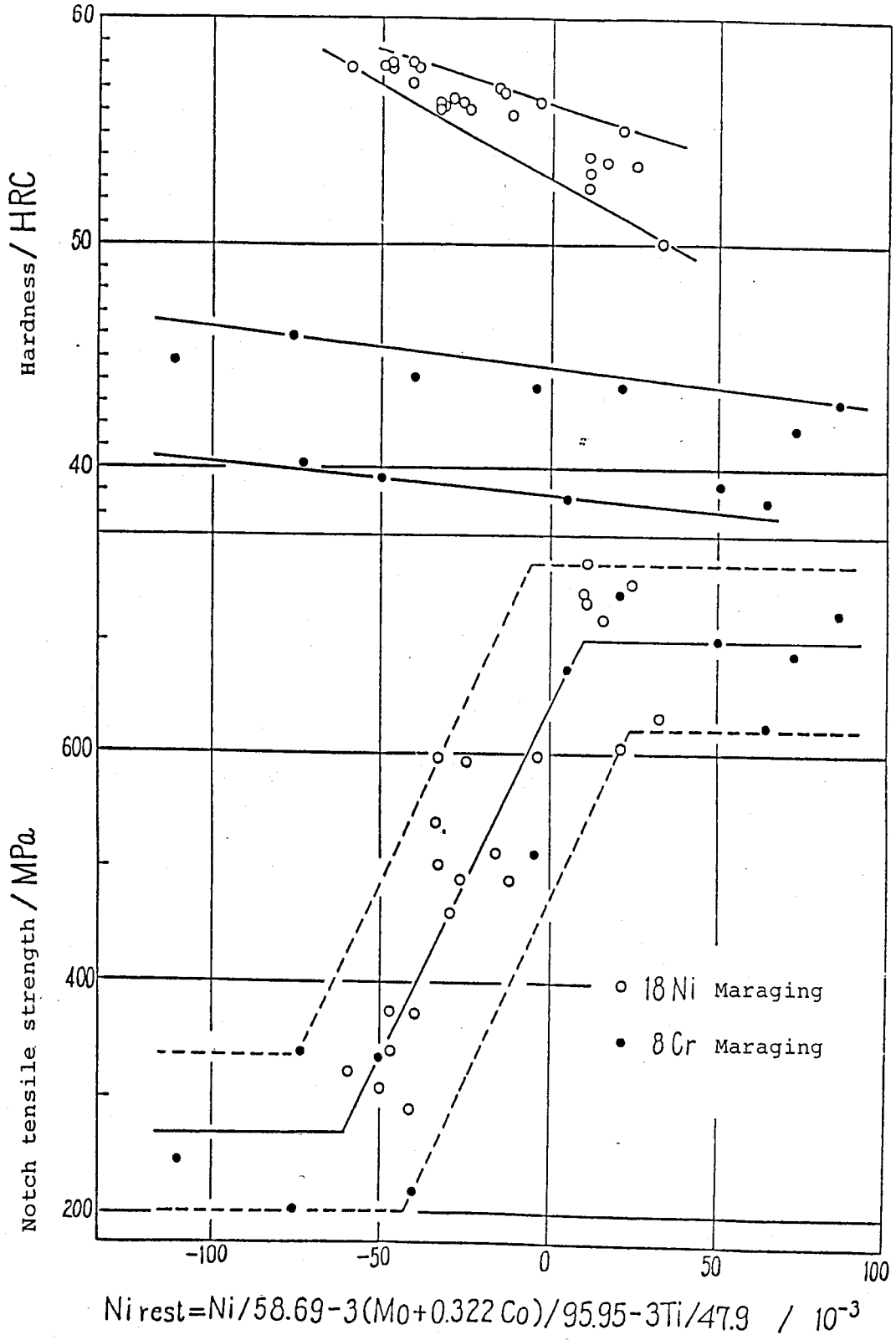
FIG. 1 is a graph showing the notch tensile strength and hardness of 18Ni maraging steel and 8Cr maraging steel in relation to the nickel rest (defined below)

Maraging steel owes its strength to the precipitation of a fine intermetallic compound by aging. Therefore, the maraging steel is usually treated by a process which comprises adding to the steel an appropriate element forming an intermetallic compound or contributing to the precipitation hardening of the steel, heating it to a high temperature to form a solid solution of the added element (solution treatment), cooling it to an ambient temperature to supersaturate it with alloying elements and aging it for precipitation hardening. The elements which contribute to precipitation hardening are, for example, Mo, Ti and Al. It is known that a tensile strength on the order of 180 kg/mm$^2$ is easy to obtain by the appropriate addition of those elements. It is, however, very difficult to obtain satisfactory toughness, and the conventional maraging steel is usually too low in toughness to be suitable for use for structural purposes.

The strength and toughness of the conventional 18Ni (Grade 250) maraging steel are due to the presence of Co and Mo therein. It has hitherto been believed that Co and Mo produce a synergistic effect which enables the steel to obtain high strength and toughness when it is aged. It is, however, not clear if the synergistic effect of these two elements really contributes to obtaining good toughness. While it may be true that cobalt assists molybdenum in improving the strength of the steel, it is not clear if cobalt really prevents the reduction in toughness which necessarily results from an increase in strength. It is true that if an increased amount of molybdenum is added to make up for a reduction in strength resulting from a reduction in the amount of cobalt in 18Ni (Grade 250) maraging steel, its toughness is lowered, since a molybdenum-rich intermetallic compound which does not form a solid solution even at a high temperature remains undissolved in the steel. This does, however, not mean that the presence of cobalt is essential for improving the toughness of maraging steel in conjunction with molybdenum.

It is known that the toughness of a particular material depends on the ease of cross slipping during plastic deformation. Referring particularly to maraging steel, it is known that the presence of nickel, which usually facilitates such cross slipping, contributes to improving the toughness of the steel. It, therefore, follows that the good toughness of maraging steel is due to the presence of a large amount of nickel therein. As nickel itself is, however, not an element which contributes to hardening maraging steel when it is aged, the precipitation hardening elements as hereinbefore mentioned are added to improve its strength. If the addition of any such element lowers the toughness of maraging steel, it is apparent that the element added for the purpose of hardening inhibits the contribution of nickel toward improving the toughness of the steel. As the amount of nickel in the matrix (iron) is reduced if the nickel forming a solid solution in iron is precipitated for some reason or other, we have studied the possibility that such inhibition may be due to an intermetallic compound which is formed by such precipitation.

It is known that $Ni_3Mo$ is an intermetallic compound precipitated when 18Ni maraging steel is aged, and that $Ni_3Ti$ is also precipitated if the steel contains titanium. A nickel- or molybdenum-rich zone is also precipitated if the steel is aged at a low temperature. No nickel-rich zone is formed if an aging temperature of at least 460° C. is employed. Therefore, $Ni_3Mo$ and $Ni_3Ti$ are the intermetallic compounds which are pertinent to the nickel content of iron on which the toughness of the aged steel depends. We, therefore, assume that these two are the only intermetallic compounds formed when 18Ni maraging steel is precipitation hardened, and that cobalt merely assists their precipitation. Based on such assumption, we have developed the concept of the "nickel rest" as a parameter indicating the amount of nickel in a solid solution in the matrix (iron) after such precipitation, and studied the relationship between the nickel rest and the notch tensile strength (corresponding to notch toughness) of a variety of species of 18 Ni maraging steel. The results are shown in FIG. 1.

The nickel rest was calculated by the following formula:

$$\text{Ni rest} = \text{Ni\%}/58.69 - 3(\text{Mo\%} + 0.322\text{Co\%})/95.95 - 3\text{Ti\%}/47.9 \quad (1)$$

where % = % by mass.

The lower half of FIG. 1 teaches that the nickel rest in 18Ni maraging steel has a significant bearing on its notch toughness, and that the nickel rest values of at least 0, and particularly at least 0.01 provide high toughness as represented by a notch tensile strength of at least 600 MPa. MPa (megapascal) is the SI unit of pressure, and 9.80665 MPa are equal to 1 kgf/mm$^2$. Although the presence of a solid solution of nickel in the matrix enables a sharp increase in the toughness of the maraging steel as its notch tensile strength shows a sharp increase when the nickel rest has a value in the vicinity of 0, there results some softening of the steel. The upper half of FIG. 1, however, assures that the maintenance of a nickel rest value of at least 0 does not substantially have any adverse effect on the hardness of the steel, as it shows only a gradual linear reduction.

FIG. 1 also shows similar test results obtained on 8Cr maraging steel. The principal chemical composition of each of the 18Ni and 8Cr maraging steels employed for the tests of which the results are shown in FIG. 1 is shown in TABLE 2.

| Sort of steel | Principal composition and Ni rest of the materials appearing in FIG. 1 | | | | | | | |
|---|---|---|---|---|---|---|---|---|
| | C | Cr | Ni | Mo | Co | Ti | Al | Ni rest |
| 101 | 0.016 | — | 18.21 | 3.07 | 7.09 | 1.95 | 0.116 | 0.021 |
| 102 | 0.028 | — | 18.13 | 3.10 | 11.00 | 1.44 | 0.102 | 0.011 |
| 103 | 0.039 | — | 18.33 | 3.13 | 11.29 | 1.84 | 0.107 | −0.026 |
| 104 | 0.025 | — | 18.00 | 3.10 | 13.73 | 0.97 | 0.098 | 0.011 |
| 105 | 0.025 | — | 18.55 | 3.15 | 14.35 | 1.36 | 0.107 | −0.012 |
| 106 | 0.023 | — | 18.31 | 3.07 | 14.10 | 1.84 | 0.107 | −0.041 |
| 107 | 0.056 | — | 18.37 | 4.23 | 7.44 | 1.30 | 0.102 | 0.024 |
| 108 | 0.022 | — | 18.25 | 4.30 | 7.10 | 1.74 | 0.102 | −0.004 |
| 109 | 0.025 | — | 18.41 | 5.35 | 7.71 | 0.92 | 0.102 | 0.011 |
| 110 | 0.026 | — | 18.29 | 5.40 | 7.15 | 1.39 | 0.116 | −0.016 |
| 111 | 0.032 | — | 17.94 | 5.27 | 7.35 | 1.70 | 0.098 | −0.040 |
| 112 | 0.027 | — | 18.33 | 4.25 | 10.62 | 0.90 | 0.107 | 0.016 |
| 113 | 0.070 | — | 18.06 | 4.23 | 11.06 | 1.41 | 0.098 | −0.024 |
| 114 | 0.049 | — | 17.58 | 4.15 | 10.66 | 1.66 | 0.118 | −0.042 |
| 115 | 0.013 | — | 18.00 | 5.30 | 11.01 | 1.23 | 0.089 | −0.047 |
| 116 | 0.036 | — | 18.25 | 5.43 | 10.75 | 0.95 | 0.098 | −0.027 |
| 117 | 0.018 | — | 17.94 | 4.37 | 14.56 | 0.89 | 0.093 | −0.033 |

-continued

| Sort of steel | Principal composition and Ni rest of the materials appearing in FIG. 1 | | | | | | | |
|---|---|---|---|---|---|---|---|---|
| | C | Cr | Ni | Mo | Co | Ti | Al | Ni rest |
| 118 | 0.022 | — | 18.23 | 4.23 | 14.23 | 1.31 | 0.098 | −0.047 |
| 119 | 0.036 | — | 17.90 | 5.27 | 14.28 | 0.89 | 0.089 | −0.059 |
| 701 | 0.050 | 7.83 | 5.88 | 3.02 | — | 0.89 | trace | −0.050 |
| 702 | 0.061 | 7.97 | 8.21 | 2.81 | — | 0.91 | " | −0.005 |
| 703 | 0.048 | 7.80 | 10.00 | 2.87 | — | 0.95 | " | 0.021 |
| 704 | 0.032 | 8.13 | 12.23 | 2.82 | — | 0.95 | " | 0.061 |
| 710 | 0.047 | 7.96 | 5.91 | 2.06 | — | 1.22 | " | −0.040 |
| 711 | 0.065 | 7.92 | 6.00 | 3.15 | — | 1.27 | " | −0.076 |
| 712 | 0.031 | 7.96 | 5.95 | 4.05 | — | 0.77 | " | −0.073 |
| 713 | 0.046 | 7.88 | 5.91 | 4.05 | — | 1.20 | " | −0.101 |
| 714 | 0.055 | 8.00 | 8.12 | 2.03 | — | 0.39 | " | 0.050 |
| 715 | 0.062 | 7.91 | 10.13 | 2.06 | — | 0.70 | " | 0.064 |
| 716 | 0.030 | 8.05 | 12.14 | 2.07 | — | 0.89 | " | 0.086 |
| 717 | 0.025 | 8.16 | 7.95 | 2.06 | 2.77 | 0.61 | " | 0.005 |

This invention is based on these research and test results, and provides a novel grade of maraging steel of the entirely novel composition which is very inexpensive, as it does not contain any expensive cobalt, or any large amount of nickel or molybdenum, and yet achieves strength and toughness which are comparable to those of any conventional maraging steel, without developing any strain when hardened.

The chemical composition of the maraging steel of this invention is as follows:

| | |
|---|---|
| Nickel | 11.0 to 15.0% (by mass) |
| Chromium | 0.5 to 4.0% |
| Molybdenum | 0.5 to 5.5% |
| Titanium | 0.5 to 2.0% |
| Carbon | Up to 0.05% max. |
| Manganese | Up to 1.0% max. |
| Silicon | Up to 0.5% max. |
| Iron | Balance |

It is necessary that the amounts of nickel, molybdenum and titanium in the steel of this invention satisfy the following relationships:

$$\text{Ni \%} \geqq \left( \frac{3 \times \text{Mo \%}}{95.95} + \frac{3 \times \text{Ti \%}}{47.9} \right) \times 58.69 \quad (2)$$

$$28\text{Mo \%} + 80\text{Ti \%} \geqq 150 \quad (3)$$

Although nickel is an element which is effective for improving the toughness of the steel, the steel does, of course, not need to contain an unnecessarily large amount of nickel. The steel obtains a satisfactorily high degree of toughness if it contains an amount of nickel which satisfies formula (2) when the amounts of molybdenum and titanium satisfy formula (3).

The solution treated steel is cooled so that its structure may be transformed to martensite. If the temperature at which such transformation begins (Ms point) is too high, however, the steel being cooled is likely to undergo precipitation and obtain inferior properties. Chromium is, therefore, employed to lower the Ms point to a level not higher than 350° C. As the Ms point varies with the amounts of Ni, Mo and Ti in the steel, the amount of the chromium to be added depends on the amounts of Ni, Mo and Ti which are so selected as to satisfy formulas (2) and (3).

Molybdenum and titanium are employed for the precipitation hardening of the steel. If their amounts are too small, the steel fails to obtain satisfactory strength; therefore, formula (3) defines the minimum amounts of Mo and Ti that are required to produce steel of satisfactory strength. As the presence of these elements in too large quantities, however, results in steel of poor toughness, their maximum allowable amounts are limited by formula (2).

It is theoretically desirable to reduce the amount of carbon as far as possible, since it is an element which is unnecessary for the steel of this invention. The steel may, however, contain a maximum of 0.05% carbon, since the efforts to reduce the amount of carbon to a further extent result in an undue increase in the cost of production. The presence of carbon in any larger quantity should be avoided, since it increases the strength of the steel as solution treated and lowers its machinability or workability. It is, however, unnecessary to lower the amount of carbon to the level of 0.03% as in the conventional maraging steel, since it has been found that the past belief that carbon is detrimental to toughness is not always correct.

The steel of this invention does not always need to be produced by vacuum melting, but can also be produced by atmospheric melting. Therefore, it contains small amounts of manganese and silicon which are required for atmospheric melting.

TABLE 3 shows the chemical composition and nickel rest values of a couple of species of 13Ni cobalt-free maraging steel developed in accordance with this invention. It also contains data on 18Ni (Grade 250) maraging steel for comparison purposes.

TABLE 3

| Sort of steel | Chemical composition and Ni rest of the materials | | | | | | | | | | | |
|---|---|---|---|---|---|---|---|---|---|---|---|---|
| | C | Si | Mn | Ni | Cr | Mo | P | S | Al | Ti | Co | Ni rest |
| No. 1 | 0.003 | 0.02 | 0.01 | 14.05 | 1.97 | 2.10 | 0.002 | 0.002 | 0.012 | 1.36 | — | 0.089 |
| No. 2 | 0.001 | 0.01 | 0.01 | 12.58 | 2.86 | 2.82 | 0.003 | 0.003 | 0.005 | 1.30 | — | 0.045 |
| 18Ni (250 G) | 0.03 | 0.10 | 0.10 | 18.0 | — | 4.9 | 0.01 | 0.01 | 0.10 | 0.4 | 7.75 | 0.050 |

As far as the nickel rest values are concerned, the 13Ni cobalt-free maraging steel of this invention is considered to be quite satisfactory, and even superior to the conventional 18Ni (Grade 250) steel.

TABLE 4 shows the mechanical properties of the same steel aged in accordance with this invention. As is obvious therefrom, the steel of this invention has a strength which is even higher than 180 kg/mm$^2$, and a notch or rupture toughness ($K_{IC}$) value which is even higher than 360 kg$\sqrt{mm}$/mm$^2$.

TABLE 4

| Sort of steel | Mechanical properties of the aged materials | | | | | | |
|---|---|---|---|---|---|---|---|
| | Heat treating conditions | | Load bearing capacity Kgf/mm$^2$ | Tensile strength Kgf/mm$^2$ | Elongation (%) G.L. 25 mm | Hardness $H_{RO}$ | $K_{IC}$ Kg $\sqrt{mm}$/mm$^2$ |
| | Solid solution treatment | Ageing | | | | | |
| No. 1 | Heating at 820° C. for 30 min. and air cooling | Heating at 510° C. for 3 h. and air cooling | 171.9 | 179.1 | 8.0 | 50.0 | 362 |
| No. 2 | Heating at 820° C. for 30 min. and air cooling | Heating at 510° C. for 3 h. and air cooling | 178.3 | 181.2 | 6.0 | 51.3 | 364 |

Although the steel of this invention can be satisfactorily produced by a customary atmospheric melting process, it is advisable to employ a vacuum melting process to reduce nonmetallic inclusions in the event the steel is used to manufacture a "critical" article, particularly an article for which fatigue strength is critical.

The steel of this invention requires solution treatment. TABLE 5 shows the transformation temperature of the steels shown in TABLE 3 and their mechanical properties as solution treated.

TABLE 5

| Sort of steel | Transformation temperature (Ms point) and mechanical properties as solution treated | | | |
|---|---|---|---|---|
| | Ms point °C. | Yield strength kgf/mm$^2$ | Tensile strength kgf/mm$^2$ | Elongation (%) G.L. 25 mm |
| No. 1 | 253 | 90.6 | 101.8 | 11.2 |
| No. 2 | 223 | 92.4 | 101.3 | 11.5 |

The Ms point of 223° or 253° C. is a temperature which is quite satisfactory. If it is too low, the steel fails to be precipitation hardened satisfactorily when it is aged after solution treatment. This possibility arises if the Ms point is, for example, lower than 100° C. In this connection, a temperature on the order of 223° to 253° C. is an optimum Ms point for the steel of this invention.

Figure 2:
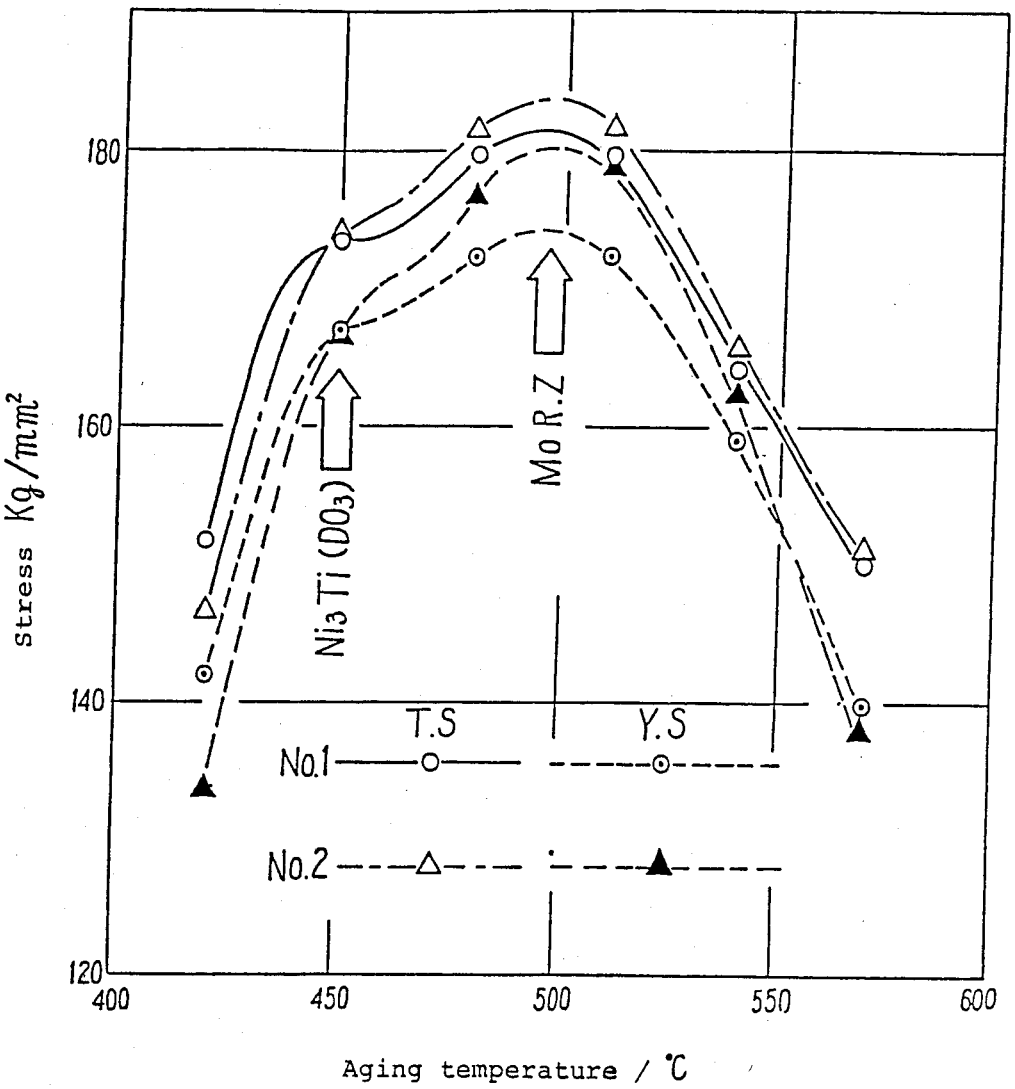
FIG. 2 is a graph showing the tensile and yield strength of the maraging steel of this invention in relation to its aging temperature.
Figure 3:
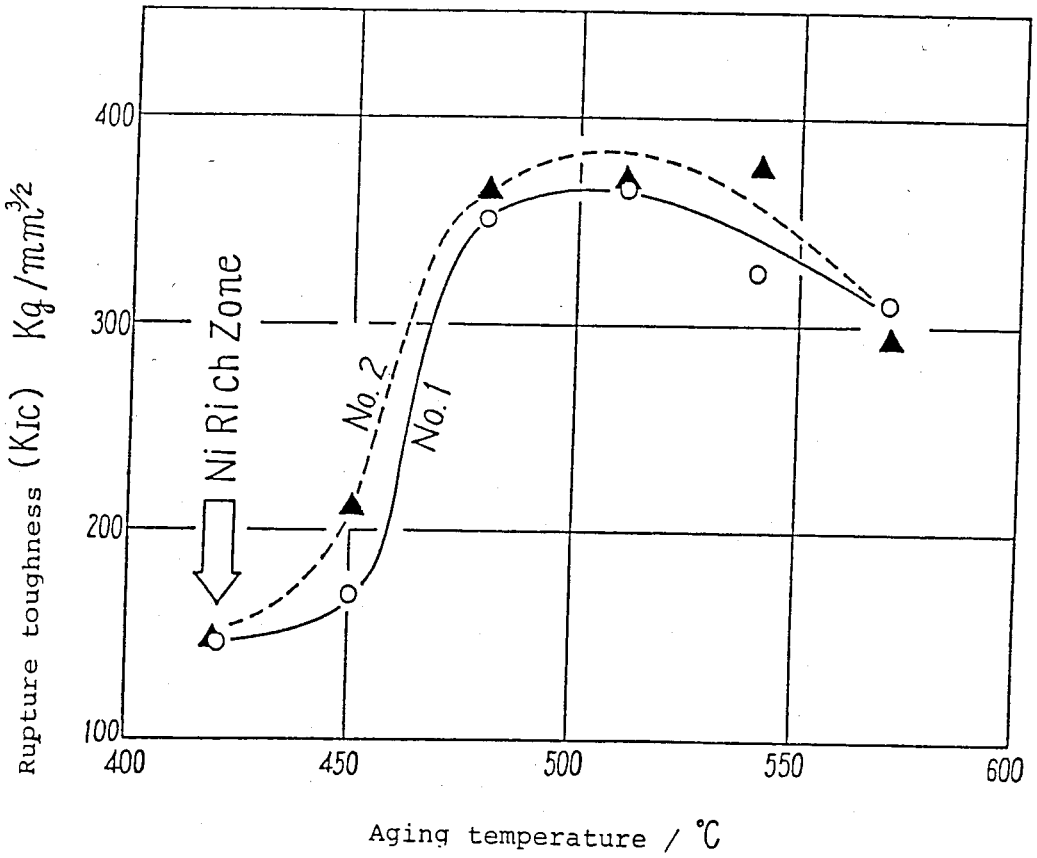
FIG. 3 is a graph showing the rupture toughness of the maraging steel of this invention in relation to its aging temperature.

FIGS. 2 and 3 show the strength (tensile strength TS and yield strength YS) of steels Nos. 1 and 2 and their rupture toughness ($K_{IC}$), respectively, in relation to the temperature at which they are aged. The steels showed a maximum strength of about 180 kg/mm$^2$ when they were aged at 500° C. They showed a low value of rupture toughness and underwent embrittling rupture when they were aged at a temperature lower than about 480° C. This is due to a reduction in the amount of nickel in the iron matrix as a result of the precipitation of a nickel-rich zone, and does not occur if an aging temperature in excess of about 480° C. is employed, since no nickel-rich zone is precipitated at a temperature over about 480° C. The steels showed a $K_{IC}$ value over 360 kg$\sqrt{mm}$/mm$^2$ when they were aged at the temperature of 500° C. at which their maximum strength was obtained. It can, therefore, be concluded that the maraging steel of this invention exhibits excellent strength and toughness if it is aged at a temperature of at least about 480° C.

The maraging steel of this invention is particularly useful for the production of, for example, missile motor casings, high strength aircraft parts, engine shafts, helicopter drive shafts, springs, dies for die casting, plastic molding dies, and various parts for use in the atomic energy or petroleum industry.

What is claimed is:

1. High strength and toughness cobalt-free maraging steel consisting essentially of, by mass, 11 to 15% Ni, 0.5 to 4% Cr, 0.5 to 5.5% Mo, 0.5 to 2% Ti, 0.05% max. C, 1% max. Mn, 0.5% max. Si, the balance iron and unavoidable impurities, the amounts of Ni, Mo and Ti satisfying the following relationship:

$$\text{Ni \%} \geqq \left( \frac{3 \times \text{Mo \%}}{95.95} + \frac{3 \times \text{Ti \%}}{47.9} \right) \times 58.69$$

$$28\text{Mo \%} + 80\text{Ti \%} \geqq 150.$$

2. A process for the heat treatment of the steel of claim 1, comprising subjecting the steel to solution treatment to form a martensitic structure therein, and aging the steel at a temperature of at least about 480° C.

* * * * *